US009971278B2

(12) United States Patent
Mizutani

(10) Patent No.: US 9,971,278 B2
(45) Date of Patent: May 15, 2018

(54) IMAGE FORMING APPARATUS INCLUDING STORAGE CONTAINER FOR STORING COLLECTED WASTE TONER

(71) Applicant: KYOCERA Document Solutions Inc., Osaka-shi, Osaka (JP)

(72) Inventor: Naoki Mizutani, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days. days.

(21) Appl. No.: 15/240,945

(22) Filed: Aug. 18, 2016

(65) Prior Publication Data

US 2017/0052477 A1 Feb. 23, 2017

(30) Foreign Application Priority Data

Aug. 20, 2015 (JP) ..... 2015-162901

(51) Int. Cl.
*G03G 21/12* (2006.01)
*G03G 15/08* (2006.01)
*G03G 15/00* (2006.01)

(52) U.S. Cl.
CPC ..... *G03G 15/0856* (2013.01); *G03G 15/556* (2013.01); *G03G 21/12* (2013.01)

(58) Field of Classification Search
CPC ... G03G 15/0856; G03G 15/556; G03G 21/12
USPC ..... 399/35
See application file for complete search history.

(56) References Cited

U.S. PATENT DOCUMENTS

2007/0196117 A1* 8/2007 Ishii ..... G03G 21/12 399/35
2009/0060536 A1 3/2009 Kumagai
2013/0028625 A1* 1/2013 Ando ..... G03G 15/556 399/35

FOREIGN PATENT DOCUMENTS

JP 2001022241 A 1/2001
JP 2007219426 A 8/2007
JP 200980473 A 4/2009
JP 2011039214 A 2/2011

* cited by examiner

*Primary Examiner* — Walter L Lindsay, Jr.
*Assistant Examiner* — Ruth Labombard
(74) *Attorney, Agent, or Firm* — Alleman Hall Creasman & Tuttle LLP

(57) ABSTRACT

An image forming apparatus includes a storage container, a detection portion, a determination portion, a first calculation portion, and a first notification processing portion. The storage container stores waste toner collected. The detection portion detects that an amount of waste toner stored in the storage container has reached a predetermined reference amount. The determination portion determines, after the detection portion detects that the amount of waste toner has reached the predetermined reference amount, whether the storage container is in a full state. The first calculation portion calculates a set time based on a waste toner increase speed at which the waste toner increases up to a point of time of the detection by the detection portion. The first notification processing portion, when the set time has elapsed since the point of time of the detection by the detection portion, makes a notification regarding a pre-full state.

10 Claims, 14 Drawing Sheets

IMAGE FORMING APPARATUS INCLUDING STORAGE CONTAINER FOR STORING COLLECTED WASTE TONER

INCORPORATION BY REFERENCE

This application is based upon and claims the benefit of priority from the corresponding Japanese Patent Application No. 2015-162901 filed on Aug. 20, 2015, the entire contents of which are incorporated herein by reference.

BACKGROUND

The present disclosure relates to an image forming apparatus including a storage container for storing collected waste toner.

An image forming apparatus, such as a multifunction peripheral, for forming an image on a recording medium by the electrophotography includes a storage container in which toner collected without being used for the image formation (hereinafter, such a toner is referred to as "waste toner") is stored. The storage container is attached to an apparatus main body in a detachable manner. When the storage container becomes full of waste toner, the image forming apparatus notifies the user of the fact that the storage container is full of waste toner so that the user can replace the storage container. In addition, when the storage container becomes full of waste toner, the image forming apparatus enters a suspended state until the storage container is replaced with a new storage container, wherein in the suspended state, an instruction to execute the image forming process is not accepted, and an execution of the image forming process is suspended.

There is known an image forming apparatus of the above-described type that makes a prior notification urging the storage container to be replaced with a new one before the storage container becomes full of waste toner. For example, the image forming apparatus makes the prior notification when a sensor detects that the weight of toner stored in a waste toner collecting container is, by a predetermined amount, less than the amount of toner in a full state. Alternatively, the image forming apparatus makes the prior notification when a sensor detects that the amount of toner stored in the waste toner collecting container has reached a predetermined toner amount. Such a prior notification is made for the user to make preparations for a quick replacement with an unused waste toner collecting container as soon as the waste toner collecting container enters the full state. That is, if the user has not prepared an unused waste toner collecting container in advance, the user needs to place an order with a company for an unused waste toner collecting container. It takes a certain time for the user to receive the ordered unused waste toner collecting container. As a result, the prior notification is made so that the user can have the certain time. When the storage container becomes full of waste toner, the image forming apparatus makes a notification regarding the fact, and enters the suspended state.

Meanwhile, the prior notification is made at a predetermined timing, regardless of the use state of the image forming apparatus, such as the number of prints. That is, the prior notification is made after an elapse of a predetermined time period since a sensor detects that a reference value before the full state has been reached.

SUMMARY

An image forming apparatus according to an aspect of the present disclosure includes an image forming portion, a storage container, a detection portion, a determination portion, a first calculation portion, and a first notification processing portion. The image forming portion forms an image based on image data. The storage container is attached to an apparatus main body in a detachable manner and stores waste toner collected from the image forming portion. The detection portion detects that an amount of waste toner stored in the storage container has reached a predetermined reference amount. The determination portion determines, after the detection portion detects that the amount of waste toner stored in the storage container has reached the predetermined reference amount, whether the storage container is in a full state where the storage container is full of waste toner. The first calculation portion calculates a set time based on a waste toner increase speed at which the waste toner in the storage container increases up to a point of time of the detection by the detection portion. The first notification processing portion, when the set time has elapsed since the point of time of the detection by the detection portion, makes a notification regarding a pre-full state which is a state before the storage container becomes the full state.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of an image forming apparatus of the present disclosure with reference to the drawings. It should be noted that the following embodiment is an example of a specific embodiment of the present disclosure and should not limit the technical scope of the present disclosure.

Figure 1:
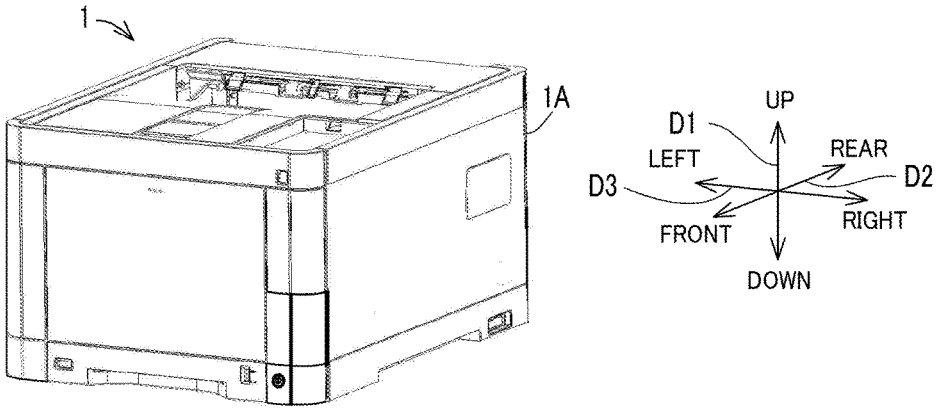
FIG. 1 is a diagram showing a configuration of an image forming apparatus according to an embodiment of the present disclosure.

FIG. 1 is an outer appearance perspective view showing a configuration of an image forming apparatus 1 according to an embodiment of the present disclosure. In the following, the present embodiment is explained by using an up-down direction D1, a front-rear direction D2, and a left-right direction D3 that are defined in FIG. 1 on the basis of a normal use state of the image forming apparatus 1.

The image forming apparatus 1 shown in FIG. 1 is a printer. The image forming apparatus 1 prints an input image on a print sheet by using a print material such as toner. It is noted that the image forming apparatus 1 is not limited to a printer, but may be a facsimile, a copier, or a multifunction peripheral having functions of these.

Figure 2:
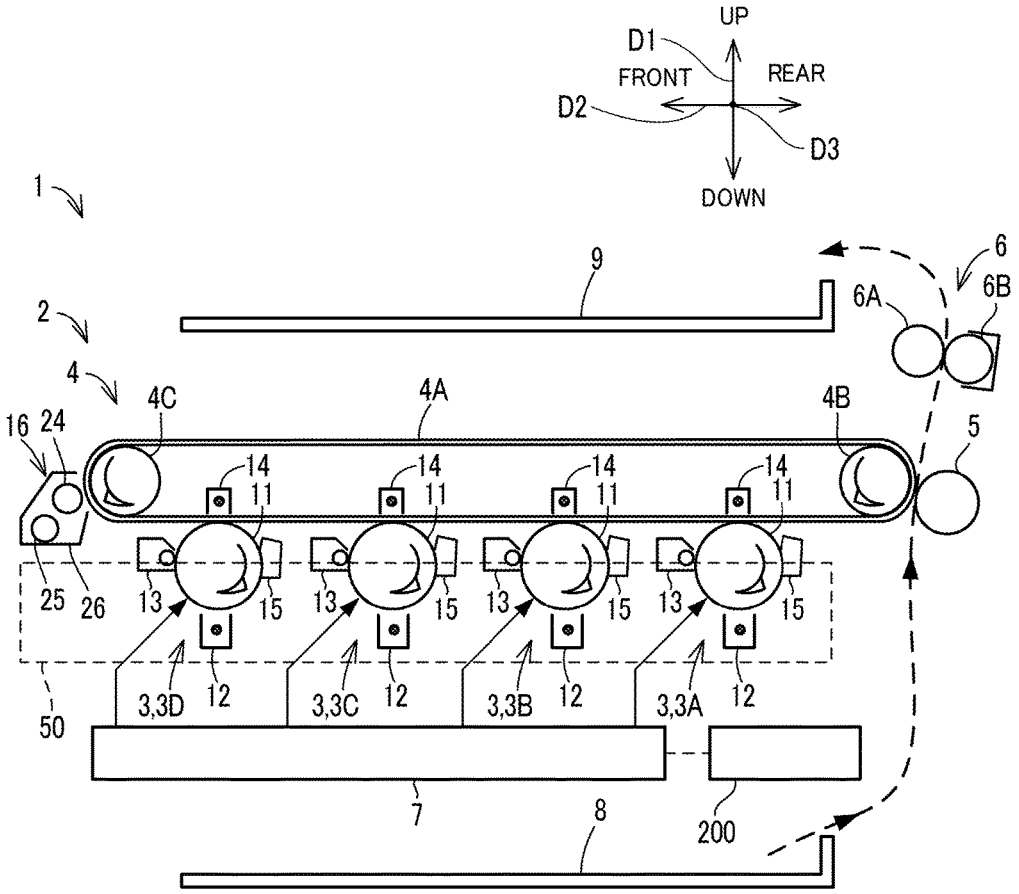
FIG. 2 is a diagram showing an internal configuration of the image forming apparatus of FIG. 1.

The image forming apparatus 1 is a color printer of a so-called tandem system. As shown in FIG. 1, the image forming apparatus 1 includes an apparatus main body 1A that includes a cover of an external frame and an internal frame. In addition, as shown in FIG. 2, the image forming apparatus 1 includes an image forming portion 2, a control portion 200, a sheet discharge portion 9, and a waste toner collecting container 50. The image forming portion 2 includes a plurality of image forming units 3 (3A-3D), an intermediate transfer unit 4, a secondary transfer device 5, a fixing device 6, an exposure device 7, a sheet feed portion 8, and a belt cleaning device 16.

The plurality of image forming units 3 (3A-3D) form images based on image data, and are arranged in alignment in the front-rear direction D2. The plurality of image forming units 3 respectively form images of different colors. In FIG. 2, an image forming unit 3A that is disposed on the most rear side forms a toner image with black toner. An image forming unit 3B that is the second from the rear forms a toner image with yellow toner. An image forming unit 3C that is the third from the rear forms a toner image with cyan toner. An image forming unit 3D that is disposed on the most front side forms a toner image with magenta toner. Each of the image forming units 3 includes a photoconductor drum 11, a charging device 12, a developing device 13, a primary transfer device 14, and a drum cleaning device 15. As a result, the image forming apparatus 1 includes a plurality of photoconductor drums 11, a plurality of developing devices 13, and a plurality of drum cleaning devices 15.

The intermediate transfer unit 4 includes an intermediate transfer belt 4A, a driving roller 4B, and a driven roller 4C. The intermediate transfer belt 4A carries a toner image that is formed from toner images of a plurality of (in the present embodiment, four) colors. Supported by the driving roller 4B and the driven roller 4C so as to be rotationally driven, the intermediate transfer belt 4A can move (run) in the state where its surface is in contact with the surfaces of the photoconductor drums 11. When the intermediate transfer belt 4A is rotationally driven, its surface passes through between the photoconductor drums 11 and the primary transfer devices 14. At that time, the toner images of respective colors are transferred in sequence from the photoconductor drums 11 to the surface of the intermediate transfer belt 4A in such a way as to be overlaid with each other.

The secondary transfer device 5 transfers the toner image transferred on the intermediate transfer belt 4A, to a print sheet that is conveyed from the sheet feed portion 8. The print sheet with the toner image transferred thereon is conveyed to the fixing device 6. The fixing device 6 includes a heating roller 6A and a pressure roller 6B. The fixing device 6 conveys the print sheet with the toner image transferred thereon while applying heat and pressure thereto. This allows the toner image to be fused and fixed to the print sheet. The print sheet with the toner image fixed thereto is further conveyed toward the downstream side, and then discharged onto and held by the tray-like sheet discharge portion 9 disposed above the intermediate transfer unit 4.

The belt cleaning device 16 is disposed in front of the intermediate transfer unit 4. The belt cleaning device 16 includes a cleaning roller 24, a screw member 25, and a toner box 26, wherein the cleaning roller 24 is a cleaning member. The cleaning roller 24 is disposed to face the driven roller 4C, and its surface is in contact with the intermediate transfer belt 4A. The cleaning roller 24 is rotatably supported in the toner box 26. The cleaning roller 24 rotates when a rotation driving force is input to the rotation shaft of the cleaning roller 24. The cleaning roller 24 has approximately the same length as the intermediate transfer belt 4A. The cleaning roller 24 is rotated while contacting the intermediate transfer belt 4A, thereby removing toner that has remained on the surface of the intermediate transfer belt 4 after the transfer of the toner image by the secondary transfer device 5. The removed toner (hereinafter referred to as "waste toner") is taken into the toner box 26 by the action of gravity or by the rotation of the cleaning roller 24. The waste toner taken into the toner box 26 is conveyed by the screw member 25. A discharge port 27 (see FIG. 4) is formed on the bottom of the toner box 26 in a right end portion thereof. The screw member 25 has helical blades around a cylindrical shaft member. Upon receiving the action of the blades while the screw member 25 is rotated, the waste toner is conveyed in the toner box 26 toward the discharge port 27. The waste toner is then discharged from the discharge port 27 to the outside. That is, the toner that has remained on the surface of the intermediate transfer belt 4A is removed by the belt cleaning device 16 and is discharged, as the waste toner, from the intermediate transfer belt 4A.

Figure 3:
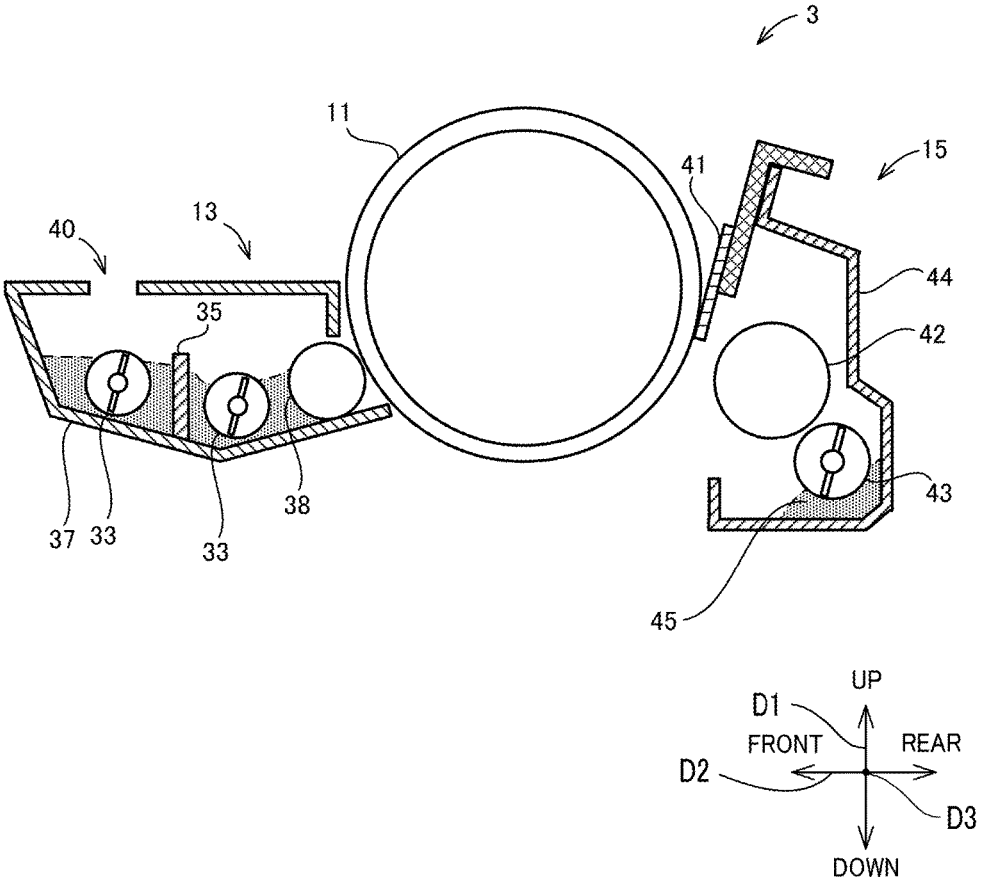
FIG. 3 is a diagram showing a configuration of an image forming portion included in the image forming apparatus of FIG. 1.

FIG. 3 is a cross-sectional view schematically showing the photoconductor drum 11, the developing device 13, and the drum cleaning device 15 of an image forming unit 3. The plurality of image forming units 3 have the same configuration except that they use toners of different colors.

Each of the photoconductor drums 11 is a cylindrical rotator with a photosensitive layer formed on its surface. The photoconductor drum 11 is rotatably supported in the apparatus main body 1A, and rotates in a predetermined direction upon input of a rotation driving force. A toner image of a corresponding color is held on the surface of the photoconductor drum 11. Specifically, when the exposure device 7 exposes the surface of the photoconductor drum 11 to light in the state where the surface of the photoconductor drum 11 has been charged to a predetermined potential by the charging device 12, an electrostatic latent image is formed on the surface of the photoconductor drum 11. The electrostatic latent image is developed by the developing device 13 that is described below. This allows a toner image to be held on the surface of the photoconductor drum 11. The toner image on the photoconductor drum 11 is transferred onto the intermediate transfer belt 4A by the primary transfer device 14.

Each of the developing devices 13 visualizes, by developer, the electrostatic latent image formed on the surface of the photoconductor drum 11. The developing device 13 includes a developer case 37 and a magnet roller 38. The developer case 37 stores the developer that includes the toner. The magnet roller 38 is used for development and is rotatably supported in the developer case 37. Screw members 33 are provided in the developer case 37. With the rotation of the screw members 33, the developer is stirred and the toner is charged to a predetermined potential. In addition, the charged toner is conveyed by the magnet roller 38 to a position that faces the photoconductor drum 11, and at the position, the toner is caused to fly toward the electrostatic latent image on the surface of the photoconductor drum 11. This allows the electrostatic latent image on the surface of the photoconductor drum 11 to be developed. The developer case 37 has a toner replenishing port 40, and the toner is replenished to the developer case 37 via the toner replenishing port 40 from a toner container (not shown).

Figure 4:
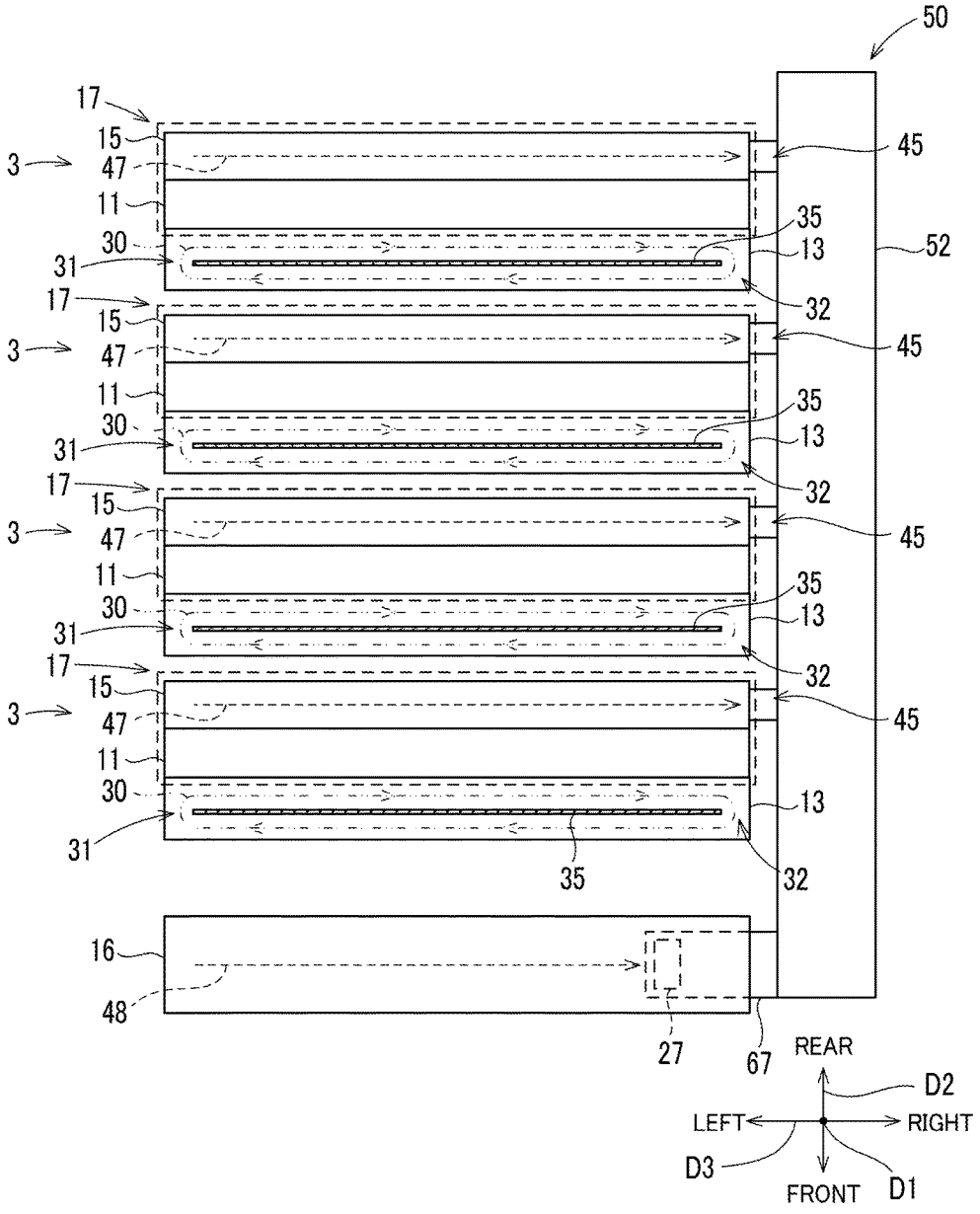
FIG. 4 is a diagram for explaining a toner flow path in which waste toner that has been removed from photoconductor drums and an intermediate transfer belt by cleaning devices, flows until it flows into a waste toner collecting container.

As shown in FIG. 4, the developer case 37 of the developing device 13 includes a partition wall 35. The partition wall 35 is erected on a bottom of the developer case 37 to extend along the longitudinal direction of the developer case 37 (a direction that matches the left-right direction D3). The inner space of the developer case 37 is partitioned into two spaces by the partition wall 35. The two spaces communicate with each other via communication portions 31 and 32 that are provided at opposite ends of the partition wall 35 in the longitudinal direction. In addition, the two spaces are each provided with a screw member 33 (see FIG. 3) that conveys the developer while stirring it. With the rotation of the screw members 33, the developer in the developer case 37 is conveyed and circulated in the two spaces along a circulation path 30 (see the two-dotted line in FIG. 4).

The drum cleaning device 15 is disposed in the rear side of the photoconductor drum 11. The drum cleaning device 15 is disposed for each of the photoconductor drums 11. The drum cleaning device 15 includes a cleaning blade 41 that is a cleaning member, a cleaning roller 42, a screw member 43, and a toner box 44. The cleaning blade 41 and the cleaning roller 42 have approximately the same length as the photoconductor drum 11. The cleaning blade 41 is disposed such that its edge is in contact with or close to the surface of the photoconductor drum 11. The cleaning roller 42 is rotatably supported in the toner box 44. The cleaning roller 42 rotates when a rotation driving force is input to the rotation shaft of the cleaning roller 42. When the photoconductor drum 11 is rotated, the cleaning blade 41 removes toner that has remained on the surface of the photoconductor drum 11 after the transfer of toner image by the primary transfer device 14. The removed toner (hereinafter referred to as "waste toner") is taken into the toner box 44 by the action of gravity or by the rotation of the cleaning roller 42. The waste toner taken into the toner box 44 is conveyed by the screw member 43 in a discharge direction as indicated by the arrow 47 in FIG. 4. A discharge port 45 (see FIG. 4) is formed in the right-end side wall of the toner box 44. The screw member 43 has helical blades around a cylindrical shaft member. Upon receiving the action of the blades while the screw member 43 is rotated, the waste toner is conveyed in the toner box 44 toward the discharge port 45. The waste toner is then discharged from the discharge port 45 to the outside. That is, the toner that has remained on the surface of the photoconductor drum 11 is removed by the drum cleaning device 15 and is discharged, as the waste toner, from the photoconductor drum 11.

Each pair of the photoconductor drum 11 and the drum cleaning device 15 is unitized as a drum unit 17 (see FIG. 4). The discharge ports 45 included in the drum cleaning devices 15 project respectively from housings (not shown) of the drum units 17 to outside and are connected to reception ports 65 (65A-65D) of the waste toner collecting container 50 that is described below.

FIG. 4 is a diagram for explaining a discharge flow path in which waste toner that has been removed from photoconductor drums 11 by the drum cleaning devices 15, and waste toner that has been removed from the intermediate transfer belt 4A by the belt cleaning device 16, flow until they are discharged into the waste toner collecting container 50.

As shown in FIG. 4, the waste toner removed by the drum cleaning device 15 is conveyed by the screw member 43 in the discharge direction (see the arrow 47) which is oriented rightward in the left-right direction D3 of the image forming apparatus 1. The waste toner that has been conveyed and arrived at the right end of the toner box 44 passes through the discharge ports 45 and the reception ports 65 (65A-65D) of the waste toner collecting container 50, and is discharged into a container main body 52 that is described below.

In addition, the waste toner removed from the intermediate transfer belt 4A by the belt cleaning device 16 is conveyed by the screw member 25 in the discharge direction (see the arrow 48) which is oriented rightward in the left-right direction D3 of the image forming apparatus 1. The waste toner that has been conveyed and arrived at the right end of the toner box 26 passes through the discharge port 27 that is provided in the bottom of the toner box 26, passes through a reception port 65 (65E) of the waste toner collecting container 50, and is discharged into the container main body 52 that is described below The waste toner collecting container 50 is attached to a predetermined storage position in the apparatus main body 1A in a detachable manner. The waste toner collecting container 50 is an example of the storage container of the present disclosure. As shown in FIG. 2, the waste toner collecting container 50 is disposed below the intermediate transfer belt 4A. In addition, as shown in FIG. 4, the waste toner collecting container 50 is disposed more on the right side than the right ends of the drum cleaning devices 15 and the belt cleaning device 16.

Figure 5:
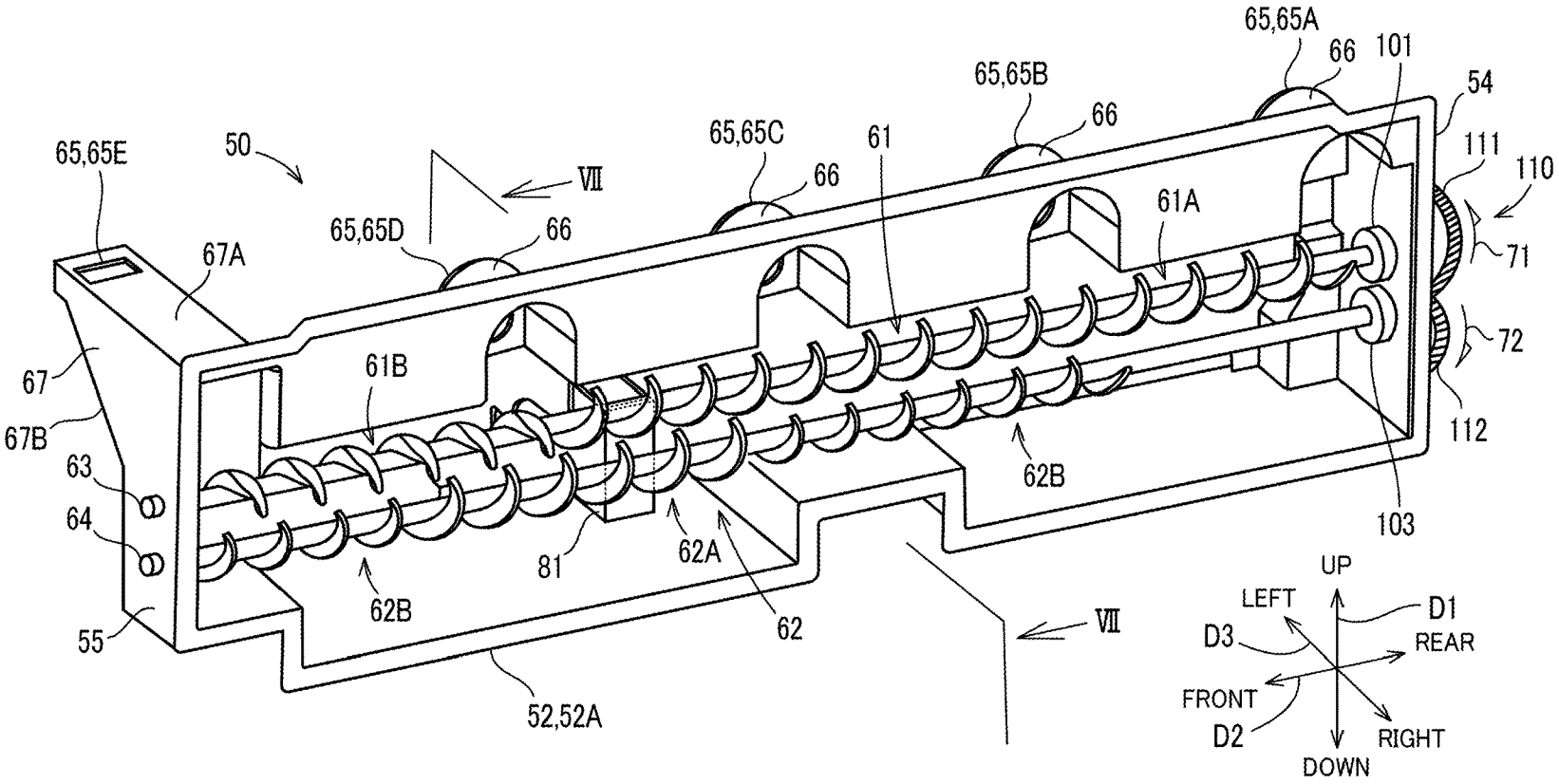
FIG. 5 is a diagram showing a configuration of the waste toner collecting container according to the embodiment of the present disclosure.
Figure 6:
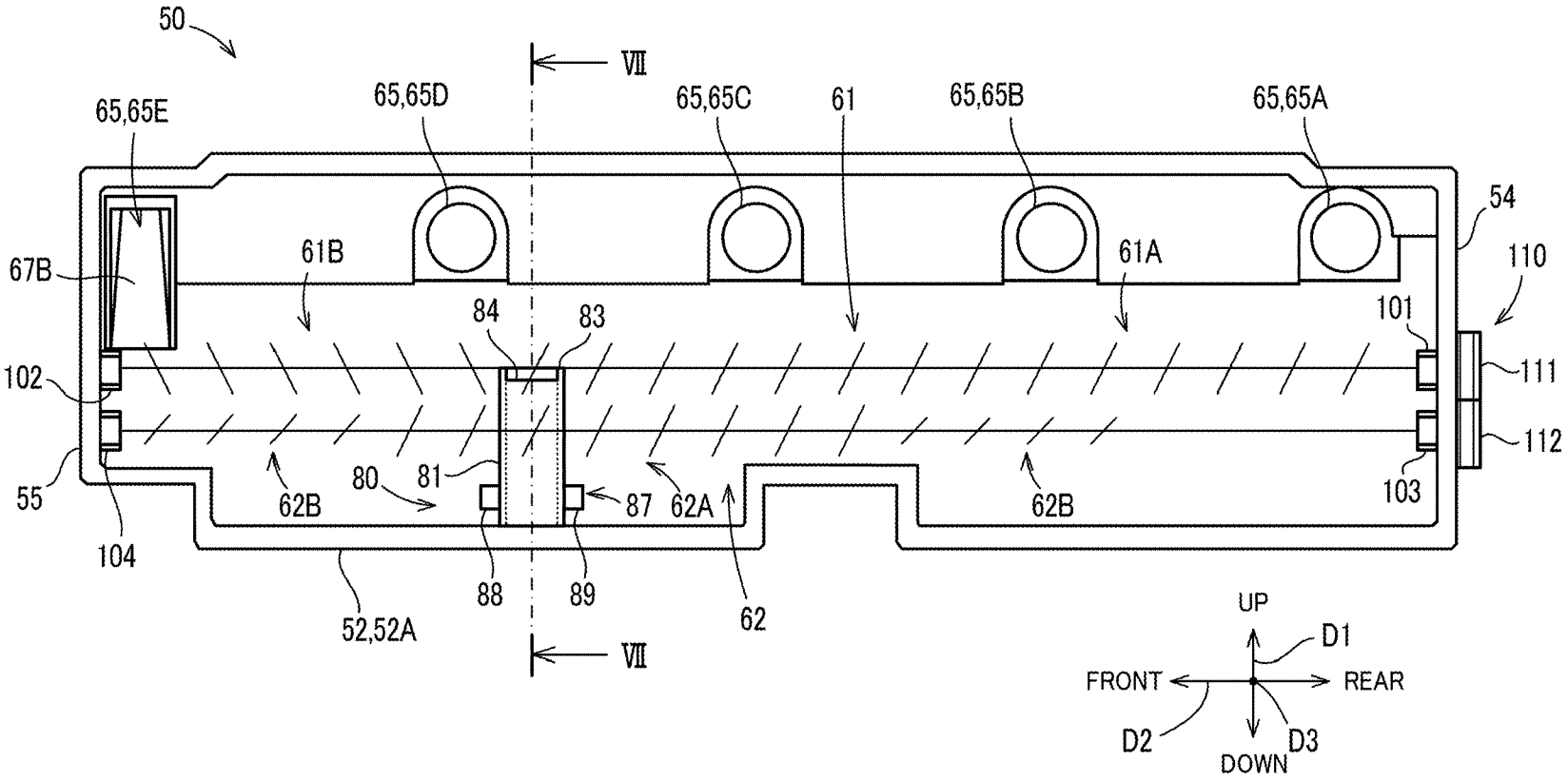
FIG. 6 is a diagram showing an internal configuration of the waste toner collecting container of FIG. 5.
Figure 7:
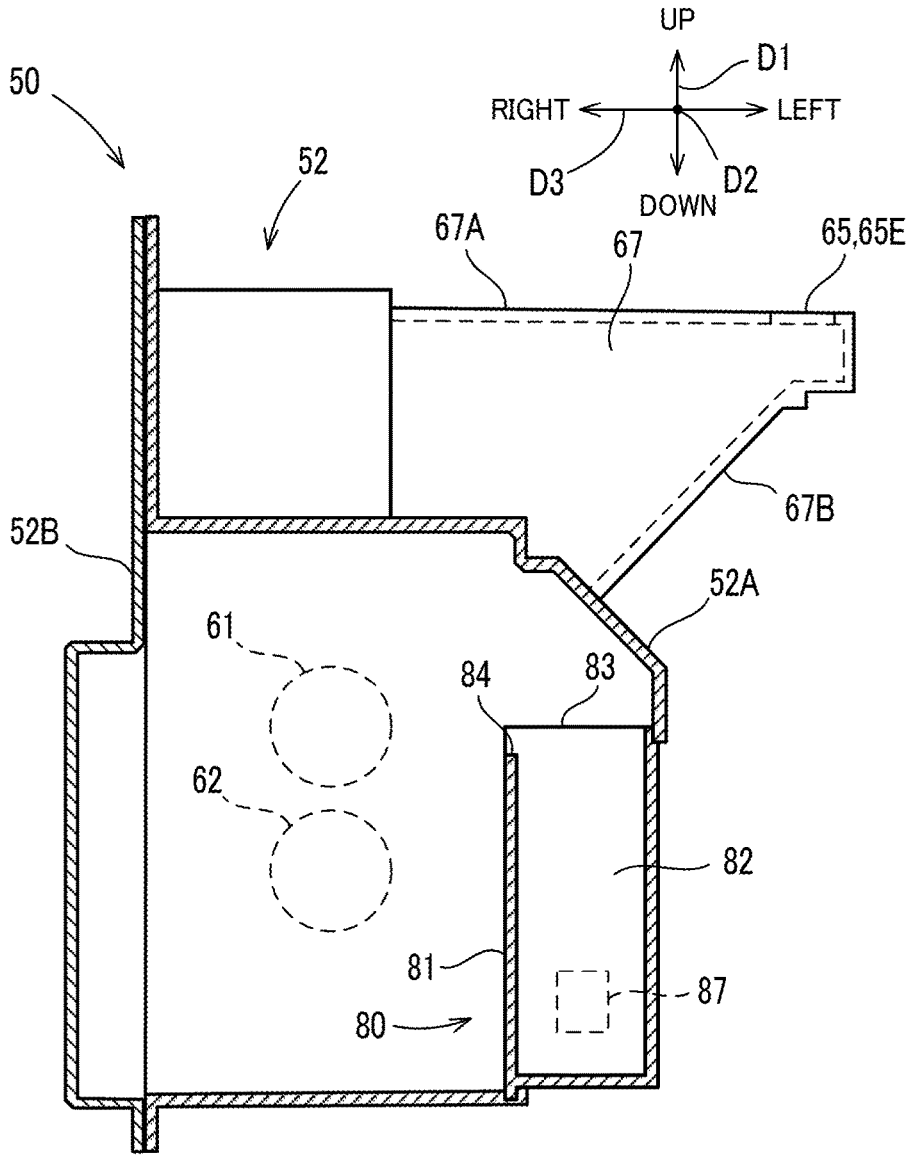
FIG. 7 is a cross-sectional view taken along a cut plane VII-VII in FIG. 5 and FIG. 6.

As shown in FIG. 5 to FIG. 7, the waste toner storing container 50 includes the container main body 52, an upper conveyance screw 61, and a lower conveyance screw 62. Here, FIG. 5 is a perspective view viewing the waste toner collecting container 50 from the right side. FIG. 6 is a side view viewing the waste toner collecting container 50 from the right side. FIG. 7 is a cross-sectional view of the waste toner collecting container 50. It is noted that in FIG. 5, a cover portion 52B that constitutes a part of the container main body 52 is omitted for the sake of convenience in explanation.

The container main body 52 is composed of a main body case 52A and the cover portion 52B (see FIG. 7). The container main body 52 is long in the front-rear direction D2. The main body case 52A constitutes a left part of the container main body 52 (the image forming units 3 side), and the cover portion 52B constitutes a right part of the container main body 52.

The waste toner discharged from the drum cleaning devices 15 and the belt cleaning device 16 is stored in the container main body 52. Specifically, as shown in FIG. 5, five reception ports 65 (65A-65E) are provided on the left side of the main body case 52A, and the waste toner flows in from the reception ports 65.

As shown in FIG. 5, four reception ports 65 (65A-65D) having the same shape are provided on the left side of the main body case 52A. The reception ports 65A-65D are provided at equal intervals in the front-rear direction D2, and disposed at approximately the same height position. The reception port 65A is positioned in the most rear side. The reception port 65A is disposed at a position corresponding to the image forming unit 3A that forms a black toner image, and is connected to the discharge port 45 of the drum cleaning device 15 of the image forming unit 3A. That is, the black waste toner that has been removed from the photoconductor drum 11 and discharged by the drum cleaning device 15 of the image forming unit 3A flows into the container main body 52 from the reception port 65A. Similarly, the reception port 65B is disposed at a position corresponding to the image forming unit 3B that forms a yellow toner image. The reception port 65C is disposed at a position corresponding to the image forming unit 3C that forms a cyan toner image. The reception port 65D is disposed at a position corresponding to the image forming unit 3D that forms a magenta toner image. The reception ports 65A-65D are respectively formed at the tips of cylindrical portions 66 that project leftward from the left side of the main body case 52A. The cylindrical portions 66 play a role of conveyance paths that guide the waste toner having entered the reception ports 65A-65D to an inside of the container main body 52.

In addition, the reception port 65E is provided in the most front side of the left side of the main body case 52A. In the most front side of the left side of the main body case 52A, a guide portion 67 projecting leftward from the left side is provided. An upper surface 67A of the guide portion 67 is horizontally flat, and the reception port 65E is formed in an end portion of the upper surface 67A at the tip of the projection. The reception port 65E is an opening that is opened upward. The inside of the guide portion 67 is hollow and the reception port 65E is communicated with the inside of the container main body 52. The bottom surface of the guide portion 67 is an inclined surface 67B that is inclined diagonally downward from the reception port 65E toward the inside of the container main body 52. The reception port 65E is formed at a position that corresponds to the belt cleaning device 16. Specifically, the reception port 65E is formed at a position where it can be connected to the discharge port 27 of the toner box 26. The discharge port 27 and the reception port 65E may be directly connected to each other or indirectly connected via a conveyance guide member (not shown) or the like. Accordingly, the waste toner that is discharged from the discharge port 27 flows into the reception port 65E. As a result, the waste toner that has been removed from the intermediate transfer belt 4A and discharged by the belt cleaning device 16 enters the reception port 65E, passes through the inside of the guide portion 67, and flows into the container main body 52 by sliding down on the inclined surface 67B.

Meanwhile, in the image forming apparatus 1, the primary transfer device 14 and the drum cleaning device 15 transfer toner images at approximately the same transfer rate. As a result, when a comparison is made between the amount of residual toner on a single photoconductor drum 11 after the transfer and the amount of residual toner on the intermediate transfer belt 4A after the transfer, it is found that the amount of residual toner on the intermediate transfer belt 4A is larger than the amount of residual toner on a single photoconductor drum 11 since toner images of a plurality of colors are overlaid on the intermediate transfer belt 4A. For example, suppose that the same amount of toner is used for each color and that the transfer rate is 90%, then the amount of toner discharged from the intermediate transfer belt 4A is 3.6 times the amount of toner discharged from a single photoconductor drum 11. That is, among the five reception ports 65 (65A-65E), a reception port having the highest inflow rate of waste toner is the reception port 65E that is disposed in the most front side. In other words, among the plurality of photoconductor drums 11 and the intermediate transfer belt 4A, an image-carrying member having the largest discharge amount of waste toner is the intermediate transfer belt 4A. In this way, there is a deviation in the inflow rate when the waste toner flows in from the five reception ports 65, thus the bulk of the waste toner in the container main body 52 is uneven in the longitudinal direction of the container main body 52. That is, the bulk of the waste toner having flowed in from the reception port 65E is higher than the bulk of the waste toner that has flowed in from each of the other reception ports. In this case, the reception port 65E is clogged with waste toner even if there is an empty space in the container main body 52, and inflow of the waste toner from the reception port 65E is interrupted. Accordingly, in the present embodiment, to eliminate a malfunction caused by the deviation in the inflow amount, the upper conveyance screw 61 is provided in the container main body 52, and the lower conveyance screw 62 is further provided below the upper conveyance screw 61.

The upper conveyance screw 61 and the lower conveyance screw 62 are rotatably provided in the container main body 52.

The upper conveyance screw 61 is rotatably provided in the container main body 52 at about the middle thereof in the up-down direction D1. The upper conveyance screw 61 is rotatably supported by bearings 101 and 102 in the state of passing through side walls 54 and 55 provided at opposite ends in the longitudinal direction and being suspended between the side walls 54 and 55. The upper conveyance screw 61 is rotationally driven by a driving motor (not shown) via a drive transmission mechanism 110 that is described below. By being rotated, the upper conveyance screw 61 conveys the waste toner in the container main body 52 in a direction along the rotation axis line.

In the present embodiment, the upper conveyance screw 61 includes a rear side conveyance portion 61A and a front-side conveyance portion 61B. In the upper conveyance screw 61, the rear-side conveyance portion 61A and the front-side conveyance portion 61B are disposed on the same axis. That is, the rear-side conveyance portion 61A is positioned in rear of the front-side conveyance portion 61B. By being rotated, the rear-side conveyance portion 61A conveys the waste toner frontward along the rotation axis line. In addition, the front-side conveyance portion 61B is provided in the front side of the upper conveyance screw 61. That is, the front-side conveyance portion 61B is adjacent to the front portion of the rear-side conveyance portion 61A in the direction along the rotation axis line. By being rotated, the front-side conveyance portion 61B conveys the waste toner rearward along the rotation axis line. The conveyance of the waste toner is realized by the helical blades formed on the upper conveyance screw 61. In the present embodiment, the blades of the rear-side conveyance portion 61A and the blades of the front-side conveyance portion 61B are formed at different angles. With this configuration, when the upper conveyance screw 61 is rotated, the rear-side conveyance portion 61A and the front-side conveyance portion 61B convey the waste toner in different directions (opposite directions).

It is noted that although the present embodiment describes the configuration where the upper conveyance screw 61 includes the rear-side conveyance portion 61A and the front-side conveyance portion 61B, the upper conveyance screw 61 may not include the front-side conveyance portion 61B. That is, the upper conveyance screw 61 may include only the rear-side conveyance portion 61A.

The lower conveyance screw 62 is rotatably provided in the lower side of the container main body 52 in the up-down direction D1. Specifically, the lower conveyance screw 62 is provided below, and parallel to, the upper conveyance screw 61. The lower conveyance screw 62 is rotatably supported by bearings 103 and 104 in the state of passing through side walls 54 and 55 provided at opposite ends in the longitudinal direction and being suspended between the side walls 54 and 55. The lower conveyance screw 62 is rotationally driven by a driving motor (not shown) via the drive transmission mechanism 110 that is described below. By being rotated, the lower conveyance screw 62 conveys the waste toner in the bottom side of the container main body 52 rearward along the rotation axis line. The lower conveyance screw 62 is rotated such that the waste toner that has flowed in from the reception port 65E is conveyed rearward so as to be away from the reception port 65E.

Meanwhile, among the waste toner stored in the container main body 52, waste toner in the upper layer has lower toner density than waste toner in the lower layer, under the influence of its own weight. Accordingly, when it is supposed that the upper conveyance screw 61 and the lower conveyance screw 62 have the same conveyance force, the amount of actually conveyed waste toner is deviated therebetween. Specifically, the amount of waste toner conveyed by the lower conveyance screw 62 is larger than the amount of waste toner conveyed by the upper conveyance screw 61. In view of this, in the present embodiment, the conveyance force of the upper conveyance screw 61 for conveying waste toner is set to be larger than the conveyance force of the lower conveyance screw 62. Specifically, the conveyance force may be made different between the upper conveyance screw 61 and the lower conveyance screw 62 by making the blades thereof different in size or inclination angle. Alternatively, the rotation speed may be made different between the upper conveyance screw 61 and the lower conveyance screw 62. With such a configuration, a deviation in the amount of actually conveyed waste toner between the upper conveyance screw 61 and the lower conveyance screw 62 is reduced. It is noted that the conveyance force may be represented by an amount of waste toner moving per unit time (an amount of conveyance).

The side wall 54 is provided with a drive transmission mechanism 110. The drive transmission mechanism 110 includes a gear 111 and a gear 112. The gear 111 is connected to an end portion of a rotation shaft 63 of the upper conveyance screw 61 that has passed through the side wall 54 to the outside, and is provided on the same axis as the upper conveyance screw 61. The gear 112 is connected to an end portion of a rotation shaft 64 of the lower conveyance screw 62 that has passed through the side wall 54 to the outside, and is provided on the same axis as the lower conveyance screw 62. The gear 111 and the gear 112 mesh with each other. The gear 111 is connected to the driving motor via an idle gear such that the drive can be transmitted. When a rotation driving force of the driving motor is transmitted to the drive transmission mechanism 110, the gear 111 is rotated in a direction of the arrow 71, and the upper conveyance screw 61 is rotated in the same direction. This allows the rear-side conveyance portion 61A to convey the waste toner frontward and the front-side conveyance portion 61B to convey the waste toner rearward. On the other hand, the gear 112 is rotated in a direction (indicated by the arrow 72) opposite to the rotation direction of the gear 111, and the lower conveyance screw 62 is rotated in the same direction. With this configuration, the lower conveyance screw 62 can convey the waste toner to the rear side.

Figure 8A:
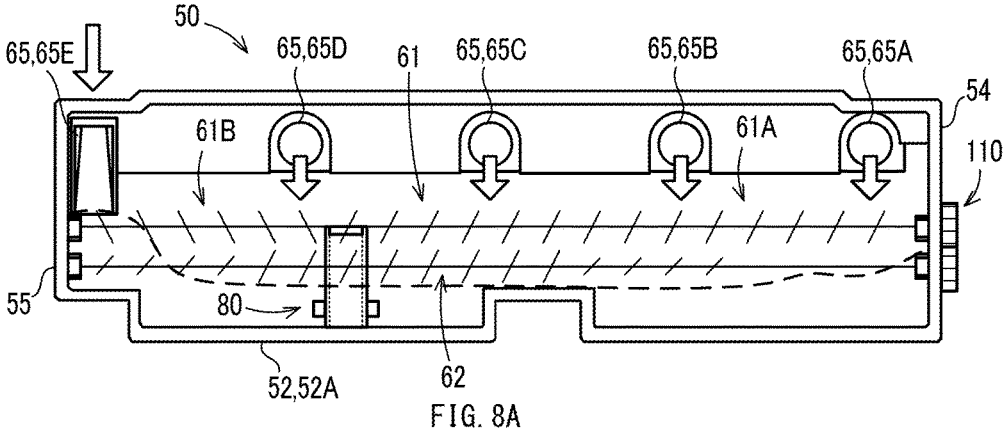
FIG. 8A, FIG. 8B, and FIG. 8C are diagrams showing how waste toner is stored in the waste toner collecting container according to the embodiment of the present disclosure.
Figure 8B:
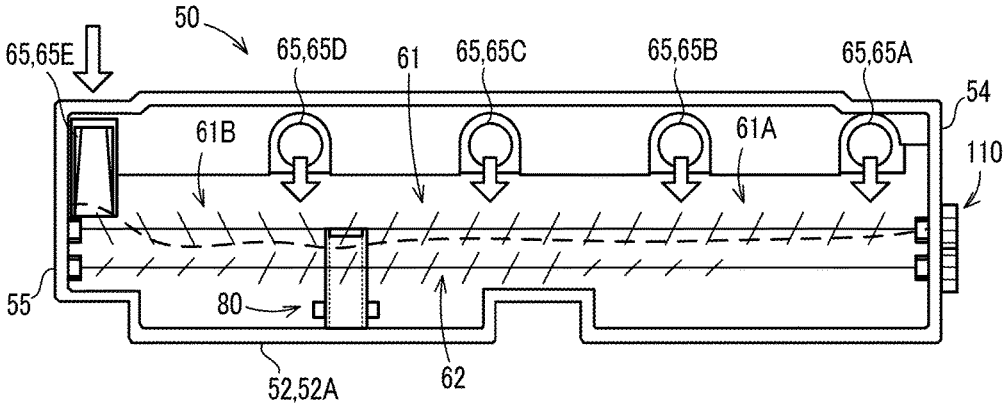

As described above, since the upper conveyance screw 61 and the lower conveyance screw 62 are disposed at a distance from each other in the vertical direction in the waste toner storing container 50, in the bottom side of the container main body 52, the waste toner is conveyed rearward by the lower conveyance screw 62, and in the upper layer of the container main body 52, the waste toner is conveyed frontward by the upper conveyance screw 61. With this configuration, even in a state where a small amount of waste toner is stored in the container main body 52 as indicated by the dotted line in FIG. 8A, the bulk of the waste toner stored in the container main body 52 is made even in the front-rear direction D2 by the conveyance of the lower conveyance screw 62. In addition, in a state where inflow of the waste toner has gradually increased and a relatively large amount of waste toner is stored in the container main body 52, the bulk of the waste toner stored in the container main body 52 is made even by the conveyances of both the upper conveyance screw 61 and the lower conveyance screw 62, as indicated by the dotted line in FIG. 8B. That is, the bulk of the waste toner is made to have an equal height. As a result of this, the container main body 52 does not have any wasteful space inside, and the waste toner can be efficiently filled in the space in the container main body 52.

In particular, with the configuration where the lower conveyance screw 62 always conveys the waste toner rearward in the bottom part of the container main body 52, even when a large amount of waste toner flows in from the reception port 65E, the waste toner is conveyed such that the bulk of waste toner is equal over the whole container main body 52.

Meanwhile, when the waste toner storing container 50 has become full of waste toner, the waste toner storing container 50 needs to be replaced. As a result, in the present embodiment, a detection mechanism 80 is provided in the container main body 52, wherein the detection mechanism 80 detects that the waste toner storing container 50 is full of waste toner. As shown in FIG. 6, the detection mechanism 80 includes a partition wall portion 81 and a first sensor portion 87. The first sensor portion 87 is an example of the sensor of the present disclosure.

The partition wall portion 81 forms an inner space 82 that is separated from the waste toner storage space in the container main body 52, and is provided in the container main body 52. Specifically, the partition wall portion 81 is formed in a rectangular shape extending upward from the bottom of the container main body 52. As shown in FIG. 7, the upper end of the partition wall portion 81 is opened, forming an opening portion 83. At the right end of the opening portion 83, a cut 84 is formed. The cut 84 is an inlet from which waste toner flows into the inner space 82 when the waste toner stored in the container main body 52 exceeds a predetermined storage amount. In the present embodiment, the upper end position of the partition wall portion 81 is set to a position that corresponds to a limit height of waste toner stored in the container main body 52. More specifically, the cut 84 is formed in the partition wall portion 81 at a position that matches the limit height of waste toner stored in the container main body 52. The limit height of waste toner stored in the container main body 52 is a height position of a bulk of waste toner when the container main body 52 is evaluated as full. The limit height of waste toner is determined from a factor such as the storage volume of the container main body 52 or the height of the reception ports 65.

As shown in FIG. 7, the partition wall portion 81 is disposed on the left side of the container main body 52, and is disposed more on the left side than the upper conveyance screw 61 and the lower conveyance screw 62. Specifically, the partition wall portion 81 is disposed adjacent to the left side wall of the container main body 52 that extends in the longitudinal direction. The partition wall portion 81 forms the inner space 82 between itself and the left side wall of the container main body 52.

The first sensor portion 87 is provided in the partition wall portion 81. The first sensor portion 87 detects that a waste toner storage space of the container main body 52 is in a certain toner storage state where the amount of toner stored in the storage space is, by a predetermined amount of toner, less than the amount of toner in the full state where the storage space is full of toner. Hereinafter, the certain toner storage state is referred to as a pre-full state. The first sensor portion 87 is, for example, composed of a light-emitting element 88 and a light-receiving element 89. In the partition wall portion 81, the light-emitting element 88 and the light-receiving element 89 are respectively provided on side walls that face each other across the inner space 82. When the container main body 52 stores an amount of waste toner corresponding to the pre-full state, and the waste toner enters the inner space 82 from the cut 84, the waste toner having entered the inner space 82 blocks the light path from the light-emitting element 88 to the light-receiving element 89. The light-receiving element 89 is connected to the control portion 200, and the control portion 200 determines whether or not the waste toner has entered the inner space 82 based on a level change of a signal from the light-receiving element 89.

Figure 8C:
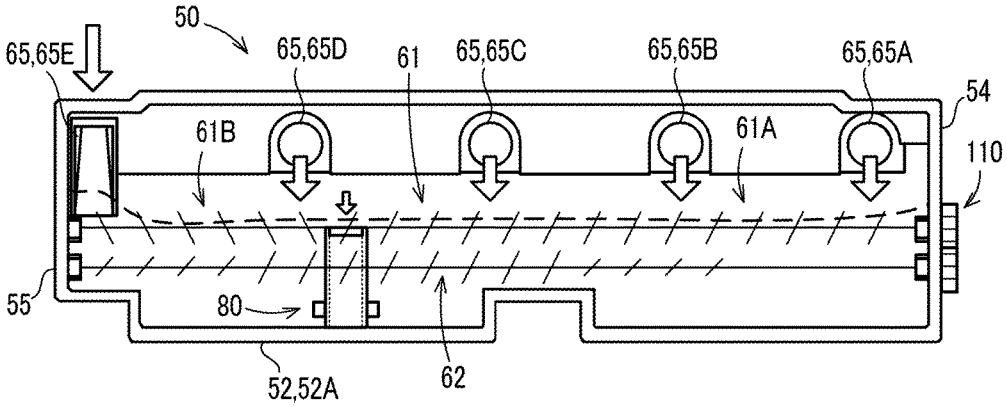

Since the detection mechanism 80 is provided in the waste toner collecting container 50 as described above, it is possible, as shown in FIG. 8C, to detect correctly that the waste toner storage amount is in the pre-full state, without making any wasteful space in the container main body 52.

In the present embodiment, the partition wall portion 81 is disposed closer to the center of the container main body 52 than to an end thereof in the longitudinal direction (a direction that matches the rotation axis line of the upper conveyance screw 61). Specifically, as shown in FIG. 6, the partition wall portion 81 is disposed between the reception port 65D and the reception port 65C, at a position closer to the reception port 65D. This position is away from the front end by approximately one third of the length of the container main body 52 in the longitudinal direction. As described above, a larger amount of waste toner flows in from the reception port 65E than from each of the other reception ports 65A-65D. That is, there is a deviation in the inflow rate among the reception ports 65. As a result, the partition wall portion 81 is disposed at such a position that divides the container main body 52 into two parts in the front-rear direction D2 such that an approximately equal amount of waste toner flows into each of the two parts from the reception ports 65. That is, a total of inflow amounts of waste toner from the reception ports 65A-65C positioned in the rear side of the partition wall portion 81 is approximately the same as a total of inflow amounts of waste toner from the reception ports 65D and 65E positioned in the front side of the partition wall portion 81.

When the partition wall portion 81 is disposed at such a position, the rear-side conveyance portion 61A of the upper conveyance screw 61 conveys the waste toner having flowed in from the reception ports 65A-65C, frontward toward the partition wall portion 81. In addition, the front-side conveyance portion 61B of the upper conveyance screw 61 conveys the waste toner having flowed in from the reception ports 65D and 65E, rearward toward the partition wall portion 81. With this configuration, the waste toner is stored in a flat state in the container main body 52. In addition, it is possible to detect the pre-full state in an early stage when the waste toner storage amount has entered the pre-full state.

Figure 9:
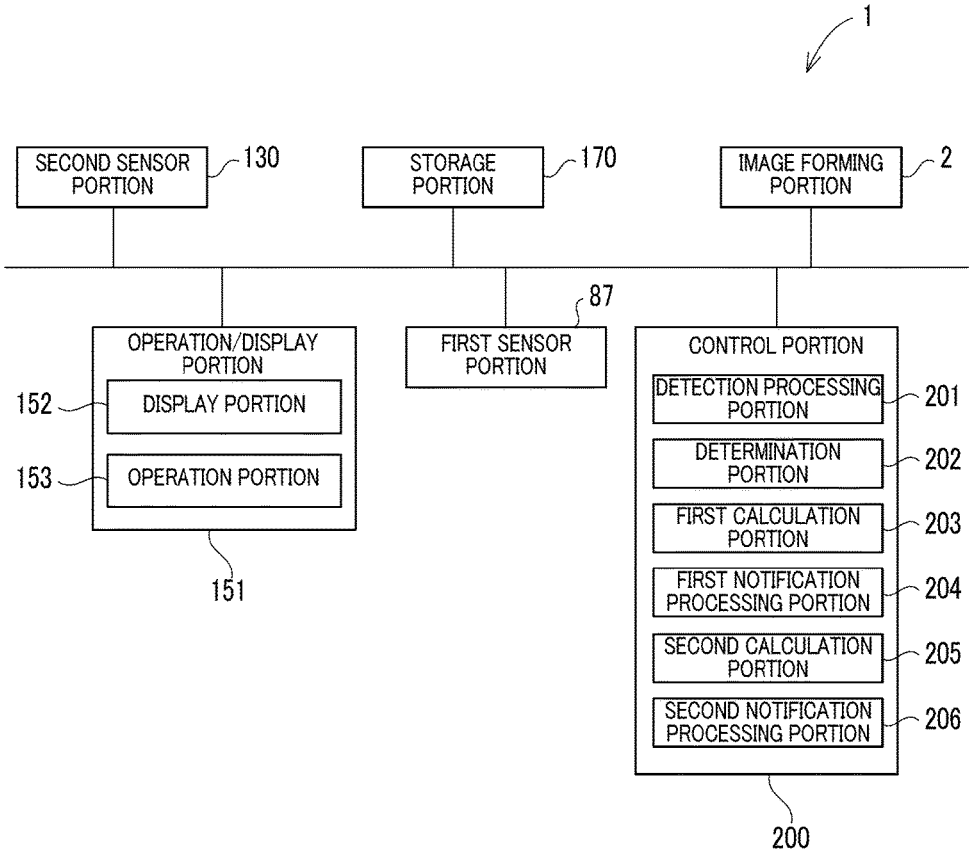
FIG. 9 is a block diagram showing a configuration of the image forming apparatus according to the embodiment of the present disclosure.

As shown in FIG. 9, the image forming apparatus 1 includes a second sensor portion 130, an operation/display portion 151, a storage portion 170, and a control portion 200.

The second sensor portion 130 detects that the waste toner collecting container 50 is stored at the storage position in the apparatus main body 1A. The second sensor portion 130 is provided in the apparatus main body 1A, and is a mechanical on/off switch. That is, the apparatus main body 1A has a storage space for storing the waste toner collecting container 50. The second sensor portion 130 includes a moving member and a switch (both not shown). The moving member is configured to move between an entering position of entering the inside of the storage space, and a retreat position of retreating from the storage space. The moving member is biased by a biasing member such as a spring so as to be positioned at the entering position. When the waste toner collecting container 50 is stored in the storage space, the moving member moves to the retreat position against the biasing force of the biasing member. The switch turns on when the moving member is positioned at the retreat position, and turns off when the moving member is positioned at a position other than the retreat position. An output signal from the second sensor portion 130 is output to the control portion 200. It is noted that the control portion 200 determines whether or not the waste toner collecting container 50 is stored in the storage space based on whether or not the output signal from the second sensor portion 130 is an ON signal. It is noted that the configuration of the second sensor portion 130 is not limited to the above-described one, but may be another one.

The operation/display portion 151 includes a display portion 152 and an operation portion 153. The display portion 152 includes, for example, a color liquid crystal display and displays various types of information for a user who operates the operation/display portion 151. The operation portion 153 includes various types of push button keys (not shown) disposed adjacent to the display portion 152, and a touch panel disposed on the display screen of the display portion 152. It is noted that, upon receiving, from the user, an operation instructing to execute any of various processes, the operation/display portion 151 outputs an operation signal corresponding to the operation, to the control portion 200.

The storage portion 170 is, for example, a hard disk or a nonvolatile memory such as an EEPROM (registered trademark: Electrically Erasable Programmable Read-Only Memory).

The control portion 200 is a microcomputer including a CPU, a ROM, and a RAM. The ROM of the control portion 200 stores control programs for causing the CPU of the control portion 200 to execute various processes. The control portion 200 comprehensively controls the image forming apparatus 1.

Meanwhile, before the waste toner collecting container 50 becomes full of waste toner, the image forming apparatus 1 performs a prior notification to urge a replacement of the waste toner collecting container 50. Each image forming apparatus 1 has a different waste toner increase speed depending on the toner use frequency in each image forming apparatus 1. As a result, the time period between the prior notification and the detection of the full state is different in each image forming apparatus 1. Accordingly, if the prior notification is performed uniformly in response to a predetermined amount of stored waste toner, following problems may occur.

For example, in an image forming apparatus 1 having a high toner use frequency, the time period between the prior notification to the detection of the full state is shorter than in an image forming apparatus 1 having a low toner use frequency. As a result, even if the user places an order for an unused waste toner collecting container 50 with a company, he/she may fail to get it before the full state is detected. In that case, the image forming apparatus 1 will be in the above-mentioned suspended state for a long time until the waste toner collecting container 50 is replaced with a new one, and the state where the image forming apparatus 1 cannot be used may last long.

On the other hand, in an image forming apparatus 1 having a low toner use frequency, a less amount of toner is consumed than in an image forming apparatus 1 having a high toner use frequency, and thus it will take a long time before the full state is detected after the prior notification is made. As a result, a relatively long time lag may occur after the user gets an unused waste toner collecting container 50 by ordering it in response to the prior notification, before the full state is detected. In that case, the user needs to stock the unused waste toner collecting container 50 for a long time until a final notification is made indicating that the present waste toner collecting container 50 is full of waste toner. On the other hand, in the present embodiment, it is possible to make the prior notification at a timing that matches the use frequency of the image forming apparatus 1.

The control portion 200 includes a detection processing portion 201, a determination portion 202, a first calculation portion 203, a first notification processing portion 204, a second calculation portion 205, and a second notification processing portion 206 as the CPU executes the processing programs stored in the ROM.

The detection processing portion 201 detects, based on the output signal from the first sensor portion 87, the pre-full state where the waste toner storage amount in the waste toner collecting container 50 has reached a predetermined reference amount. The predetermined reference amount is less than the amount of toner in the full state by a predetermined amount of toner. The first sensor portion 87 and the detection processing portion 201 correspond to the detection portion of the present disclosure.

The determination portion 202 determines, after the detection processing portion 201 detects the pre-full state, whether the waste toner collecting container 50 is in a full state where the waste toner collecting container 50 is full of waste toner.

The first calculation portion 203 calculates a wait time based on the waste toner increase speed in the waste toner collecting container 50 up to a point of time when the detection processing portion 201 detected the pre-full state. The wait time is a time period elapsing from the detection of the pre-full state by the detection processing portion 201 to the time when the first notification processing portion 204 makes the prior notification. The waste toner increase speed is an amount of waste toner stored in the waste toner collecting container 50 per unit time. The wait time is an example of the set time of the present disclosure.

The first notification processing portion 204, when the wait time has elapsed since the detection of the pre-full state by the detection processing portion 201, notifies that the waste toner collecting container 50 will be full soon. Here, it may be notified as well that an unused waste toner collecting container 50 should be prepared.

The second calculation portion 205 calculates an additional storage amount that is an amount of waste toner to be stored in the waste toner collecting container 50 after the detection processing portion 201 detects the pre-full state. The additional storage amount is an amount of waste toner to be additionally stored in the waste toner collecting container 50 after the detection processing portion 201 detects the pre-full state, and is calculated based on the number of dots of an image to be formed from the detection of the pre-full state by the detection processing portion 201. Specifically, there is a predetermined relationship between the number of dots of an image and the amount of consumed toner, and between the amount of consumed toner and the amount of waste toner. Thus, there is a fixed relationship between the number of dots of image data and the amount of waste toner. The control portion 200 calculates, as the additional storage amount, an amount of waste toner that is to be generated by the formation of the image, based on the number of dots of the image that are to be input after the detection of the pre-full state by the detection processing portion 201, by using a relational expression that represents a relationship between the number of dots of the image and the amount of waste toner.

The second notification processing portion 206, when the determination portion 202 determines that the waste toner collecting container 50 is in the full state, notifies that the waste toner collecting container 50 is in the full state.

When image data is input to the image forming apparatus 1, the storage portion 170 stores an accumulation value that is obtained by accumulating the number of dots of image data. Specifically, when image data is input to the image forming apparatus 1, the number of dots of the image data is detected by the control portion 200. The control portion 200 accumulates the number of dots of the image data that has been input to the image forming apparatus 1 from the time of the most recent replacement of the waste toner collecting container 50, and stores the accumulation value thereof to the storage portion 170.

Next, an example of a full-state notifying process executed by the control portion 200 is described with reference to FIG. 10 to FIG. 13. In the flowcharts of FIG. 10 to FIG. 13, steps S1001, S1002, . . . represent processing procedure (step numbers). Here, the processes of the flowcharts of FIG. 10 to FIG. 13 are executed by the control portion 200 when the image forming apparatus 1 is powered on.

<Step S1001>

Figure 10:
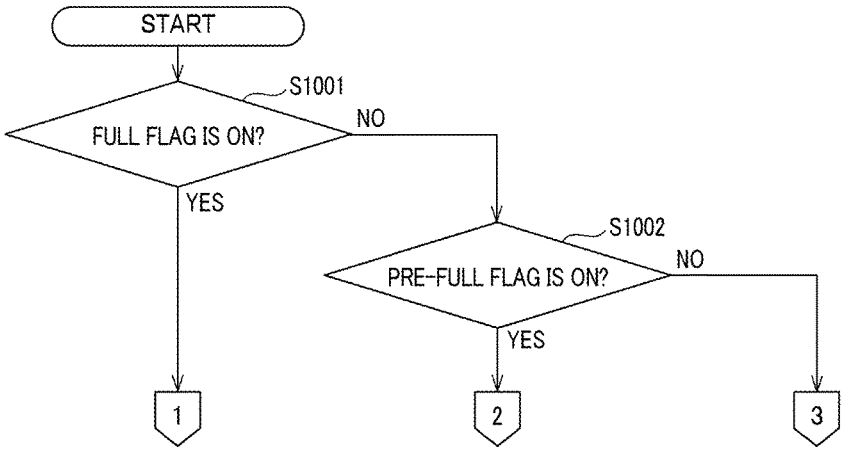
FIG. 10 is a flowchart showing a full-state notifying process executed by a control portion.

As shown in FIG. 10, when the image forming apparatus 1 is powered on, in step S1001, the control portion 200 determines whether or not a full flag is ON. Here, the full flag is a register storing information indicating that the waste toner collecting container 50 is in the full state. Specifically, when the full flag is ON, it indicates that the waste toner collecting container 50 is in the full state, and when the full flag is OFF, it indicates that the waste toner collecting container 50 is not in the full state. The initial value of the full flag is OFF. Upon determining that the full flag is ON (YES at step S1001), the control portion 200 executes the process of step S1101. On the other hand, upon determining that the full flag is OFF (NO at step S1001), the control portion 200 executes the process of step S1002.

<Step S1002>

In step S1002, the control portion 200 determines whether or not a pre-full flag is ON. Here, the pre-full flag is a register storing information indicating that the waste toner collecting container 50 is in the pre-full state, and is accessed by the first notification processing portion 204. Specifically, when the pre-full flag is ON, it indicates that the waste toner collecting container 50 is in the pre-full state, and when the pre-full flag is OFF, it indicates that the waste toner collecting container 50 is not in the pre-full state. The initial value of the pre-full flag is OFF. Upon determining that the pre-full flag is ON (YES at step S1002), the control portion 200 executes the process of step S1201. On the other hand, upon determining that the pre-full flag is OFF (NO at step S1002), the control portion 200 executes the process of step S1301.

<Step S1101>

Figure 11:
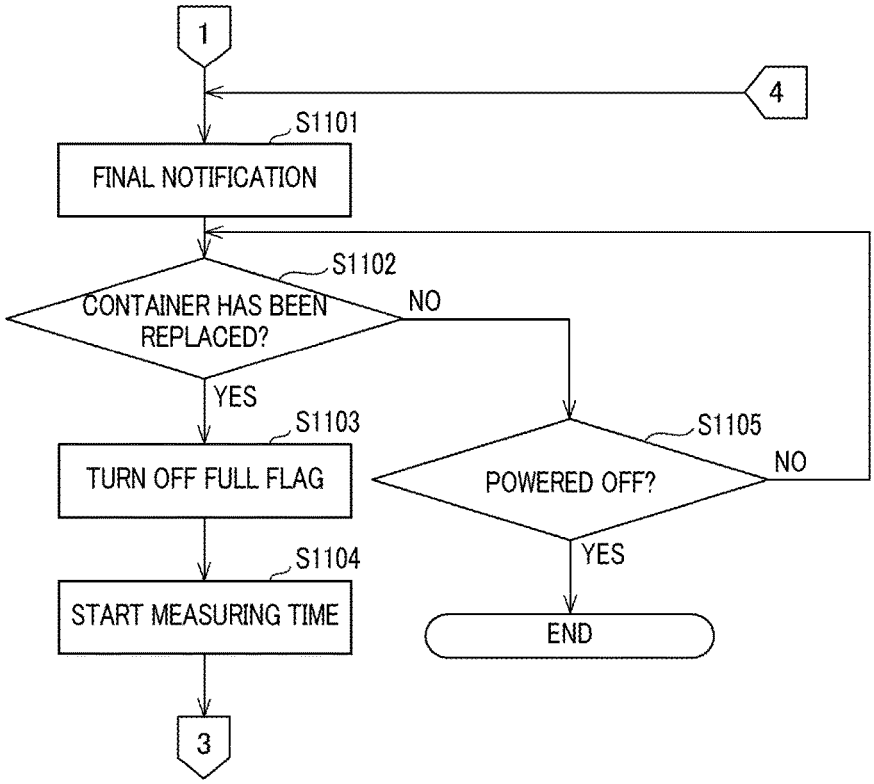
FIG. 11 is a flowchart showing the full-state notifying process executed by the control portion.

As shown in FIG. 11, in step S1101, the control portion 200 makes the final notification based on the fact that the full flag is ON. In the final notification, the control portion 200 notifies that the waste toner collecting container 50 is full of waste toner, by a message display or audio. The final notification is a notification regarding the full state. This process is executed by the second notification processing portion 206.

<Step S1102>

In step S1102, the control portion 200 determines whether or not the waste toner collecting container 50 has been replaced, based on the output signals from the first sensor portion 87 and the second sensor portion 130. That is, immediately after the waste toner collecting container 50 is replaced with an unused waste toner collecting container 50, the waste toner collecting container 50 is neither in the full state nor in the pre-full state. As a result, the waste toner collecting container 50 is in a state where the first sensor portion 87 has not yet detected the pre-full state. In addition, when the waste toner collecting container 50 is removed from the apparatus main body 1A, an OFF signal is output from the second sensor portion 130, and when an unused waste toner collecting container 50 is attached to the apparatus main body 1A, an ON signal is output from the second sensor portion 130. Accordingly, when the waste toner collecting container 50 is replaced with an unused waste toner collecting container 50, signals output from the second sensor portion 130 change from the ON signal to the OFF signal and to the ON signal. As a result, the control portion 200 determines whether or not the waste toner collecting container 50 has been replaced with an unused waste toner collecting container 50, based on whether or not the waste toner collecting container 50 is in the state where the first sensor portion 87 has not detected the pre-full state, and whether or not signals output from the second sensor portion 130 have changed from the ON signal to the OFF signal and to the ON signal. The control portion 200 determines that the waste toner collecting container 50 has been replaced with an unused waste toner collecting container 50 in the case where the first sensor portion 87 has not yet detected the pre-full state and signals output from the second sensor portion 130 have changed from the ON signal to the OFF signal and to the ON signal. On the other hand, when output signals from the second sensor portion 130 have not changed in that way, the control portion 200 determines that the waste toner collecting container 50 has not been replaced with an unused waste toner collecting container 50. Upon determining that the waste toner collecting container 50 has been replaced (YES at step S1102), the control portion 200 executes the process of step S1103. On the other hand, upon determining that the waste toner collecting container 50 has not been replaced (NO at step S1102), the control portion 200 executes the process of step S1105.

<Step S1103>

In step S1103, the control portion 200 turns off the full flag.

<Step S1104>

In step S1104, upon replacement of the waste toner collecting container 50 with an unused waste toner collecting container 50, the control portion 200 causes a timer (not shown) to start measuring the time.

<Step S1105>

In step S1105, the control portion 200 determines whether or not the image forming apparatus 1 has been powered off. Upon determining that the image forming apparatus 1 has been powered off (YES at step S1105), the control portion 200 ends the full-state notifying process. On the other hand, upon determining that the image forming apparatus 1 has not been powered off (NO at step S1105), the control portion 200 executes the process of step S1102 again.

<Step S1201>

Figure 12:
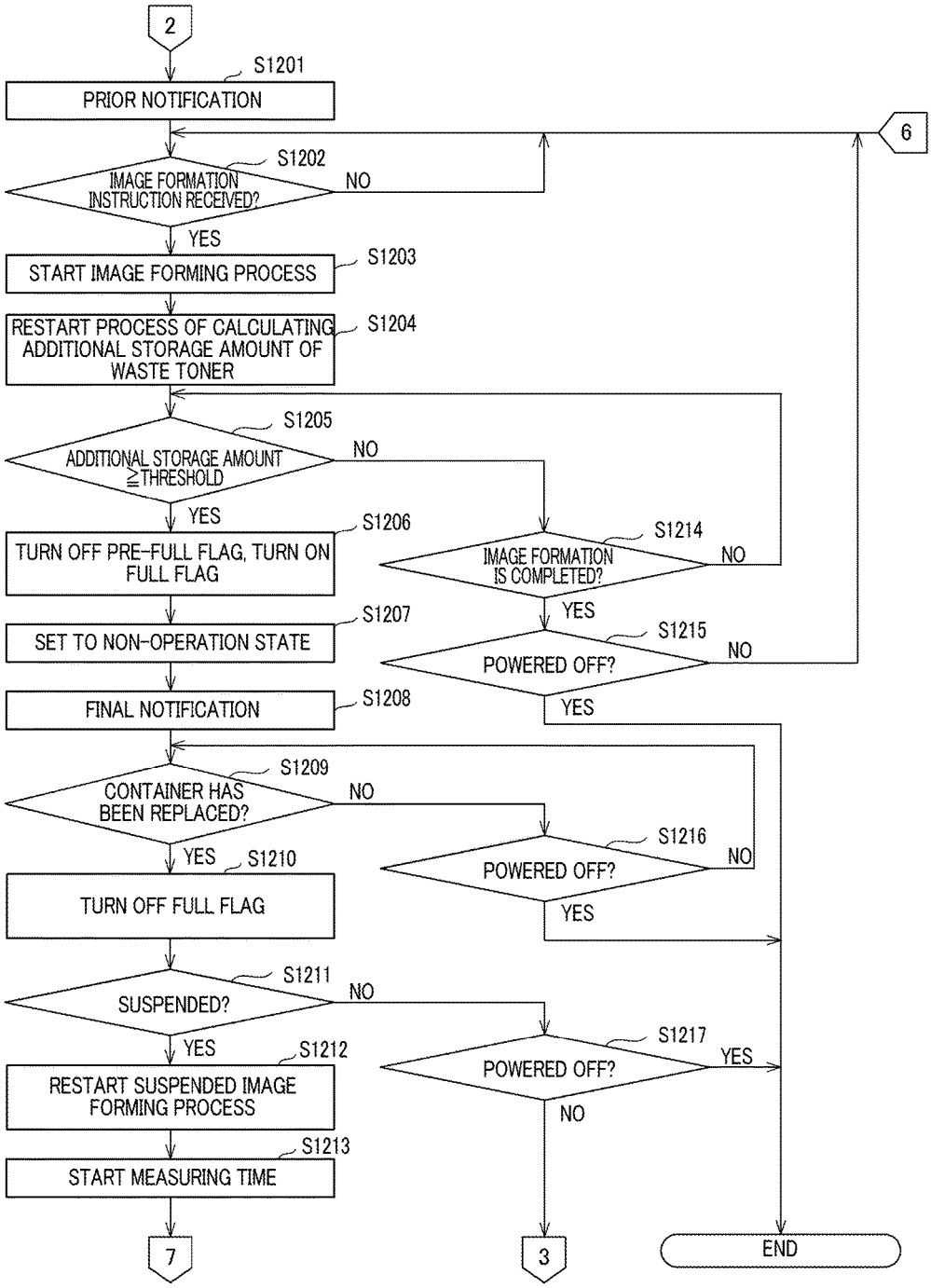
FIG. 12 is a flowchart showing the full-state notifying process executed by the control portion.

As shown in FIG. 12, in step S1201, the control portion 200 makes the prior notification. The prior notification is a notification regarding the pre-full state. This process is executed by the first notification processing portion 204.

<Step S1202>

In step S1202, the control portion 200 determines whether or not an instruction to execute the image forming process has been received. Upon determining that an instruction to execute the image forming process has been received (YES at step S1202), the control portion 200 executes the process of step S1203.

<Step S1203>

In step S1203, the control portion 200 causes the image forming portion 2 to execute the image forming process.

<Step S1204>

In step S1204, the control portion 200 restarts the process of calculating the additional storage amount of waste toner. The additional storage amount is an amount of waste toner to be additionally stored in the waste toner collecting container 50 after the detection processing portion 201 detects the pre-full state, and is calculated based on the number of dots of an image to be formed after the detection processing portion 201 detects the pre-full state. Specifically, there is a predetermined relationship between the number of dots of an image and the amount of consumed toner, and between the amount of consumed toner and the amount of waste toner. Thus, there is a fixed relationship between the number of dots of image data and the amount of waste toner. The control portion 200 calculates an amount of waste toner that is generated when an image is formed, by using a relational expression that represents a relationship between the number of dots of an image and the amount of waste toner, based on the number of dots that was input in step S1202. This process is executed by the second calculation portion 205. The control portion 200 (second calculation portion 205) has suspended the calculation process due to the power-off of the image forming apparatus 1, and restarts the calculation process in response to the start of the image forming process in step S1203. Each time the additional storage amount of waste toner is calculated by the control portion 200, information of the calculated additional storage amount of waste toner is stored in the storage portion 170, and the information is held even when the image forming apparatus 1 is powered off.

<Step S1205>

In step S1205, the control portion 200 determines whether or not the calculated additional storage amount is equal to or greater than a predetermined threshold. Upon determining that the calculated additional storage amount is smaller than the predetermined threshold (NO at step S1205), the control portion 200 executes the process of step S1214. On the other hand, upon determining that the calculated additional storage amount is equal to or greater than the predetermined threshold (YES at step S1205), the control portion 200 executes the process of step S1206. This process is executed by the determination portion 202.

It is noted that, during the time period between the detection of the pre-full state by the detection processing portion 201 and the full state, the amount of waste toner is considered to increase at the same speed as the waste toner increase speed before the detection of the pre-full state. As a result, it is possible to estimate a time period required for the waste toner storage amount in the waste toner collecting container 50 to change from the pre-full state to the full state. Thus, the determination portion 202 may use the following determination method to determine whether or not the waste toner collecting container 50 is in the full state. Specifically, the determination portion 202 may estimate the time period based on the waste toner increase speed calculated in step S1306 that is described below, and when the time period has elapsed since the detection of the pre-full state, determine that the waste toner collecting container 50 is in the full state.

<Step S1206>

In step S1206, the control portion 200 turns off the pre-full flag, and turns on the full flag.

<Step S1207>

In step S1207, the control portion 200 sets the image forming apparatus 1 to a non-operation state. The non-operation state is a state where an instruction to execute the image forming process is not accepted, and the execution of the image forming process is suspended.

<Step S1208>

In step S1208, the control portion 200 makes the final notification. This process is executed by the second notification processing portion 206.

<Step S1209>

In step S1209, the control portion 200 determines, by the same method as in step S1102, whether or not the waste toner collecting container 50 has been replaced, based on the output signals from the first sensor portion 87 and the second sensor portion 130. Upon determining that the waste toner collecting container 50 has been replaced (YES at step S1209), the control portion 200 executes the process of step S1210. On the other hand, upon determining that the waste toner collecting container 50 has not been replaced (NO at step S1209), the control portion 200 executes the process of step S1216.

<Step S1210>

In step S1210, the control portion 200 turns off the full flag.

<Step S1211>

In step S1211, the control portion 200 determines whether or not the image forming portion 2 has been caused to suspend the image forming process. Upon determining that the image forming portion 2 has been caused to suspend the image forming process (YES at step S1211), the control portion 200 executes the process of step S1212. On the other hand, upon determining that the image forming portion 2 has not been caused to suspend the image forming process (NO at step S1211), namely, there is no image forming process to be restarted, the control portion 200 executes the process of step S1217.

<Step S1212>

In step S1212, the control portion 200 causes the image forming portion 2 to restart the suspended image forming process.

<Step S1213>

In step S1213, the control portion 200 causes the timer to start measuring the time. The timer measures the time that is used to calculate the waste toner increase speed at which the waste toner is stored in the waste toner collecting container 50 until the detection of the pre-full state. Subsequently, the control portion 200 executes the process of step S1304.

<Step S1214>

In step S1214, the control portion 200 determines whether or not the image forming process performed by the image forming portion 2 is completed. Upon determining that the image forming process is completed (YES at step S1214), the control portion 200 executes the process of step S1215. On the other hand, upon determining that the image forming process is not completed (NO at step S1214), the control portion 200 executes the process of step S1205 again.

<Step S1215>

In step S1215, the control portion 200 determines whether or not the image forming apparatus 1 has been powered off. Upon determining that the image forming apparatus 1 has been powered off (YES at step S1215), the control portion 200 ends the full-state notifying process. On the other hand, upon determining that the image forming apparatus 1 has not been powered off (NO at step S1215), the control portion 200 executes the process of step S1202 again.

<Step S1216>

In step S1216, the control portion 200 determines whether or not the image forming apparatus 1 has been powered off. Upon determining that the image forming apparatus 1 has been powered off (YES at step S1216), the control portion 200 ends the full-state notifying process. On the other hand, upon determining that the image forming apparatus 1 has not been powered off (NO at step S1216), the control portion 200 executes the process of step S1209 again.

<Step S1217>

In step S1217, the control portion 200 determines whether or not the image forming apparatus 1 has been powered off. Upon determining that the image forming apparatus 1 has been powered off (YES at step S1217), the control portion 200 ends the full-state notifying process. On the other hand, upon determining that the image forming apparatus 1 has not been powered off (NO at step S1217), the control portion 200 executes the process of step S1301.

<Step S1301>

Figure 13:
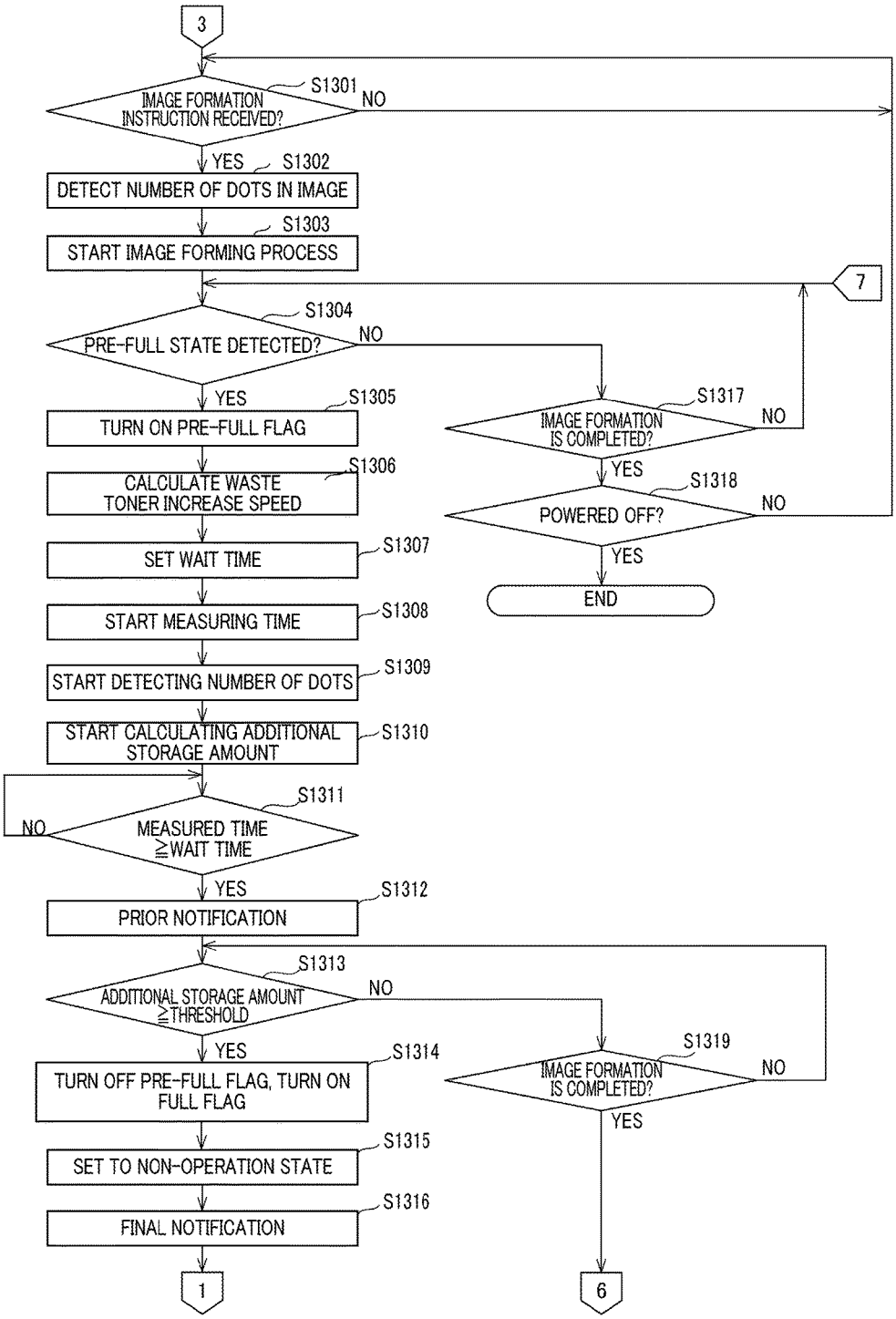
FIG. 13 is a flowchart showing the full-state notifying process executed by the control portion.

As shown in FIG. 13, in step S1301, the control portion 200 determines whether or not an instruction to execute the image forming process has been received. Upon determining that an instruction to execute the image forming process has been received (YES at step S1301), the control portion 200 executes the process of step S1302.

<Step S1302>

In step S1302, the control portion 200 detects the number of dots of an image included in the image formation job. The control portion 200 adds the detected number of dots to the accumulation value of the number of dots stored in the storage portion 170, and stores information of the accumulation value after the addition to the storage portion 170. The number of dots detected by the control portion 200 is used to calculate (step S1306) the waste toner increase speed at which the waste toner is stored in the waste toner collecting container 50 until the detection of the pre-full state.

<Step S1303>

In step S1303, the control portion 200 causes the image forming portion 2 to execute the image forming process.

<Step S1304>

In step S1304, the control portion 200 determines whether or not the waste toner collecting container 50 is in the pre-full state, based on the output signal from the first sensor portion 87. Upon determining that the waste toner collecting container 50 is in the pre-full state (YES at step S1304), the control portion 200 executes the process of step S1305. On the other hand, upon determining that the waste toner collecting container 50 is not in the pre-full state (NO at step S1304), the control portion 200 executes the process of step S1317. This process is executed by the detection processing portion 201.

<Step S1305>

In step S1305, the control portion 200 turns on the pre-full flag.

<Step S1306>

In step S1306, the control portion 200 calculates the waste toner increase speed at which the waste toner had been stored in the waste toner collecting container 50 up to the point of time when the detection processing portion 201 detected the pre-full state. In the present embodiment, the control portion 200 calculates an amount of waste toner stored in the waste toner collecting container 50, based on the number of dots of an image represented by image data stored in the storage portion 170. This process is executed by the first calculation portion 203. It is noted that the control portion 200 may calculate the waste toner increase speed based on a replacement frequency of the waste toner collecting container 50. That is, the replacement frequency is a time period between the previous replacement and the present replacement of the waste toner collecting container 50. The waste toner increase speed may be calculated by dividing the amount of waste toner stored in the waste toner collecting container 50 in the full state by the time period between the previous replacement and the present replacement.

<Step S1307>

In step S1307, the control portion 200 sets the wait time based on the waste toner increase speed calculated in step S1306. The waste toner increase speed is calculated by dividing the amount of waste toner in the pre-full state by the time that started to be measured in step S1104. The wait time is preset in data of a table format (a look-up table) such that the higher the waste toner increase speed is, the shorter the wait time is, and a wait time corresponding to the calculated waste toner increase speed is obtained from the look-up table. The obtained wait time is stored in the ROM of the control portion 200, the storage portion 170 or the like. It is noted that the method of setting the wait time is not limited to the method of obtaining from a look-up table. For example, the wait time may be calculated based on an arithmetic expression including, as a parameter, a storage amount of waste toner per unit time.

<Step S1308>

In step S1308, the control portion 200 causes a timer (not shown) to start measuring the time. The time measured by the timer is used in the process of step S1310.

<Step S1309>

In step S1309, the control portion 200 starts detecting the number of dots of image data.

<Step S1310>

In step S1310, the control portion 200 starts detecting the additional storage amount.

<Step S1311>

In step S1311, the control portion 200 determines whether or not the time that started to be measured in step S1308 is equal to or greater than the wait time set in step S1307. Upon determining that the measured time is equal to or greater than the wait time (YES at step S1311), the control portion 200 executes the process of step S1312. Upon determining that the measured time is smaller than the wait time (NO at step S1311), the control portion 200 executes the process of step S1311 again.

<Step S1312>

In step S1312, the control portion 200 makes the prior notification. This process is executed by the first notification processing portion 204.

<Step S1313>

In step S1313, the control portion 200 determines whether or not the additional storage amount is equal to or larger than the threshold. Upon determining that the additional storage amount is equal to or larger than the threshold (YES at step S1313), the control portion 200 executes the process of step S1314. On the other hand, upon determining that the additional storage amount is smaller than the threshold (NO at step S1313), the control portion 200 executes the process of step S1319.

<Step S1314>

In step S1314, the control portion 200 turns off the pre-full flag, and turns on the full flag.

<Step S1315>

In step S1315, the control portion 200 sets the image forming apparatus 1 to the non-operation state.

<Step S1316>

In step S1316, the control portion 200 makes the final notification.

<Step S1317>

In step S1317, the control portion 200 determines whether or not the image forming process performed by the image forming portion 2 is completed. Upon determining that the image forming process is completed (YES at step S1317), the control portion 200 executes the process of step S1318. On the other hand, upon determining that the image forming process is not completed (NO at step S1317), the control portion 200 returns to the process of step S1304.

<Step S1318>

In step S1318, the control portion 200 determines whether or not the image forming apparatus 1 has been powered off. Upon determining that the image forming apparatus 1 has been powered off (YES at step S1318), the control portion 200 ends the full-state notifying process. On the other hand, upon determining that the image forming apparatus 1 has not been powered off (NO at step S1318), the control portion 200 returns to the process of step S1301.

<Step S1319>

In step S1319, the control portion 200 determines whether or not the image forming process performed by the image forming portion 2 is completed. Upon determining that the image forming process is completed (YES at step S1319), the control portion 200 executes the process of step S1202. On the other hand, upon determining that the image forming process is not completed (NO at step S1319), the control portion 200 returns to the process of step S1313.

As described above, in the present embodiment, the time period (the wait time) elapsing from the detection of the pre-full state to the prior notification is set based on the waste toner increase speed in the waste toner collecting container 50. With this configuration, an image forming apparatus 1 having a low use frequency and an image forming apparatus 1 having a high use frequency have approximately the same time period between the prior notification and the full state. That is, the prior notification is made at a timing that matches the use frequency of the image forming apparatus 1. As a result, in the image forming apparatus 1 having a high use frequency, this configuration reduces the possibility that the user cannot get, before the full state is detected, an unused waste toner collecting container 50 for which an order has been placed with a company. In addition, in the image forming apparatus 1 having a low use frequency, this configuration reduces the possibility that the user has to stock an unused waste toner collecting container 50 for a long time until a final notification is made indicating that the present waste toner collecting container 50 is full of waste toner.

It is noted that the image forming apparatus 1 of the present embodiment is of a type in which the waste toner collecting container 50 collects the waste toner discharged from the drum cleaning device 15 and the belt cleaning device 16. However, the image forming apparatus 1 of the present embodiment is not limited to this type. For example, the present disclosure is applicable to an image forming apparatus including a waste toner collecting container 50 that can collect waste toner discharged from the developing device 13, as well. In addition, the present disclosure is applicable to an image forming apparatus including a waste toner collecting container 50 that can collect waste toner discharged from one or two devices among the drum cleaning device 15, the belt cleaning device 16, and the developing device 13.

Figure 14:
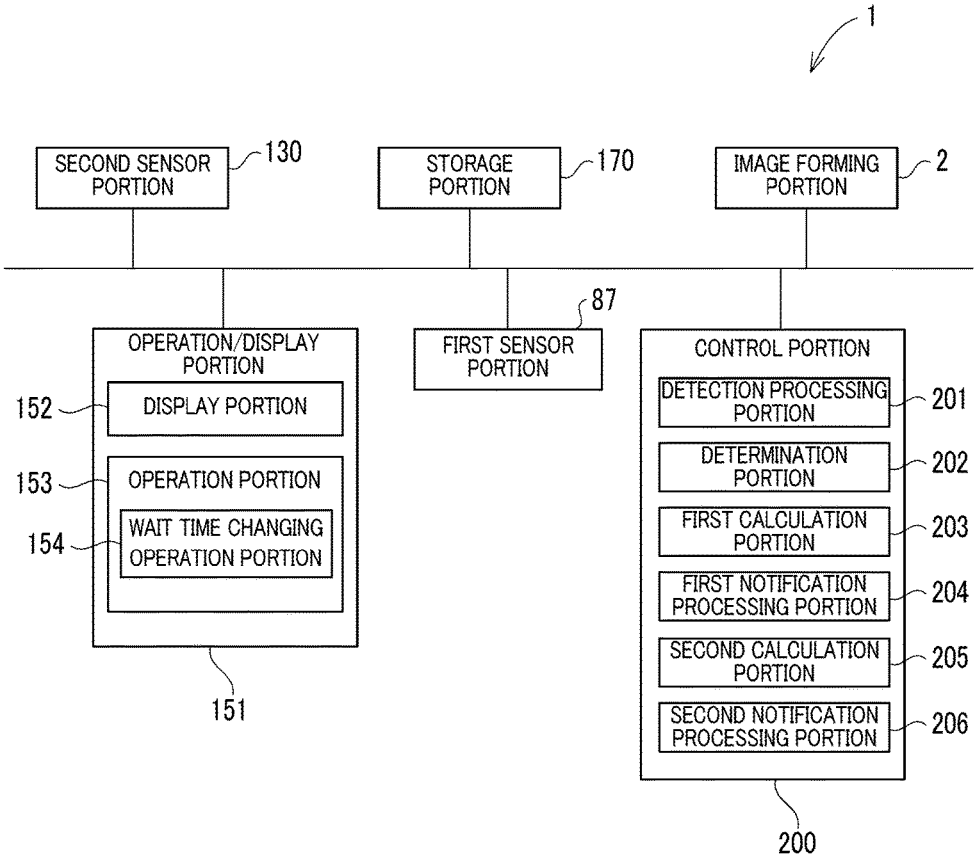
FIG. 14 is a block diagram showing a configuration of an image forming apparatus according to a modification of the present disclosure.

Furthermore, the first calculation portion 203 may be configured to change the wait time based on a user operation performed on the operation portion 153, or an instruction signal received from an external apparatus that is communicably connected to the image forming apparatus 1. For example, as shown in FIG. 14, the operation portion 153 may include a wait time changing operation portion 154. When an operation for changing the wait time is performed on the wait time changing operation portion 154, an operation signal for the operation is output from the wait time changing operation portion 154 to the control portion 200. The first calculation portion 203 of the control portion 200 receives the operation signal, and changes the wait time. The wait time changing process performed by the first calculation portion 203 is executed as an interruption process when the operation signal is received after the process of step S1307.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image forming portion configured to form an image based on image data;

a storage container attached to an apparatus main body in a detachable manner, long in a front-rear direction, having a plurality of reception ports arranged in alignment in the front-rear direction, and configured to store waste toner collected through the plurality of reception ports from the image forming portion;

a partition wall portion provided in the storage container, extending upward from a bottom of the storage container, forming an inner space that is separated from a waste toner storage space in the storage container, and disposed closer to a center of the storage container than to an end thereof in the front-rear direction;

a detection portion configured to detect that an amount of waste toner stored in the storage container has reached a predetermined reference amount by detecting that the waste toner stored in the storage space has entered the inner space from an upper opening of the partition wall portion;

an upper conveyance screw rotatably provided in the storage container to extend in the front-rear direction, and configured to, by being rotated, convey the waste toner in the storage container frontward and rearward in the front-rear direction, the upper conveyance screw including:

a front-side conveyance portion configured to convey the waste toner in the storage container rearward toward the partition wall portion; and a rear-side conveyance portion configured to convey the waste toner in the storage container frontward toward the partition wall portion;

a lower conveyance screw rotatably provided in the storage container below, and parallel to, the upper conveyance screw to extend in the front-rear direction, and configured to, by being rotated, convey the waste toner in the storage container rearward in the front-rear direction;

a determination portion configured to determine, after the detection portion detects that the amount of waste toner stored in the storage container has reached the predetermined reference amount, whether the storage container is in a full state where the storage container is full of waste toner;

a first calculation portion configured to calculate a set time based on a waste toner increase speed at which the waste toner in the storage container increases up to a point of time of the detection by the detection portion; and a first notification processing portion configured to, when the set time has elapsed since the point of time of the detection by the detection portion, make a notification regarding a pre-full state which is a state before the storage container becomes the full state.

2. The image forming apparatus according to claim 1, further comprising:

a second calculation portion configured to calculate an additional storage amount that is an amount of waste toner to be stored in the storage container after the detection by the detection portion, wherein the determination portion determines that the storage container is in the full state when the additional storage amount calculated by the second calculation portion reaches a predetermined threshold.

3. The image forming apparatus according to claim 2, wherein the second calculation portion calculates the additional storage amount based on a number of dots in the image represented by the image data.

4. The image forming apparatus according to claim 1, wherein the determination portion estimates, based on the waste toner increase speed, a time period required from the point of time of the detection by the detection portion to a point of time when the storage container enters the full state, and when the time period has elapsed since the point of time of the detection by the detection portion, determines that the storage container is in the full state.

5. The image forming apparatus according to claim 1, further comprising:

a storage portion configured to, in response to an input of image data to the image forming apparatus, store an accumulation value that is obtained by accumulating a number of dots of the image data, wherein the first calculation portion calculates the waste toner increase speed based on a number of dots stored in the storage portion, and calculates the set time based on the waste toner increase speed.

6. The image forming apparatus according to claim 1, wherein the first calculation portion calculates the waste toner increase speed based on a replacement frequency of a storage portion, and calculates the set time based on the waste toner increase speed.

7. The image forming apparatus according to claim 1, wherein the set time is preset such that the higher the waste toner increase speed is, the shorter the set time is.

8. The image forming apparatus according to claim 1, wherein the first calculation portion changes the set time in response to a predetermined user operation.

9. The image forming apparatus according to claim 1, wherein the detection portion includes a sensor configured to detect that the waste toner stored in the storage space has entered the inner space.

10. The image forming apparatus according to claim 1, further comprising:

a second notification processing portion configured to, when the determination portion determines that the storage container is in the full state, make a notification regarding the full state.

* * * * *